United States Patent [19]

Drmaj

[11] 4,259,751

[45] Apr. 7, 1981

[54] CONSTRUCTION OF CHILDREN'S CLOTHING

[76] Inventor: Diana Drmaj, P.O. Box 419, Brooklin, Ontario, Canada

[21] Appl. No.: 125

[22] Filed: Jan. 2, 1979

[30] Foreign Application Priority Data

Oct. 31, 1978 [CA] Canada ..... 315679

[51] Int. Cl.[3] ..... A41D 27/10

[52] U.S. Cl. ..... 2/269

[58] Field of Search ..... 2/269, 211, 243

[56] References Cited

U.S. PATENT DOCUMENTS

| | | | |
|---|---|---|---|
| 2,338,552 | 1/1944 | Stephenson | 2/269 |
| 2,527,973 | 10/1950 | Thomas et al. | 2/269 |
| 2,677,829 | 5/1954 | Rothstein et al. | 2/269 |
| 4,149,275 | 4/1979 | Sanchez | 2/269 |

FOREIGN PATENT DOCUMENTS

| | | | |
|---|---|---|---|
| 1381539 | 11/1964 | France | 2/269 |
| 748375 | 5/1956 | United Kingdom | 2/269 |

*Primary Examiner*—Doris L. Troutman

*Attorney, Agent, or Firm*—Zarley, McKee, Thomte, Voorhees & Sease

[57] ABSTRACT

The present invention presents a manner of construction of a child's garment in which the material at the hem or cuff is turned up twice, stitched permanently along the lower edge and stitched with a removable stitching along the upper edge so that the removable stitching can be severed and the leg of the garment lengthened as the child grows.

2 Claims, 11 Drawing Figures

CONSTRUCTION OF CHILDREN'S CLOTHING

This invention relates to improvements in the construction of children's clothing. In particular, it relates to improvements in the construction of slacks for children which will allow the garment to be lengthened easily as children grow.

It has long been recognized as a problem that children tend to grow at a rate which causes them to grow out of their clothing faster than the clothing becomes worn out or obsolete. To offset this, there is a tendency to purchase clothes for children which are initially too large in the expectation that the child will "grow into" the garment. However, this means that the garment is as unsuitable or unattractive during its initial life as a small garment is as the end of its life.

The problem is particularly acute in respect to the length of the leg of slacks, trousers or overalls where shortness above the ankle becomes quickly and readily noticeable. Many garment makers make no provision for this fact, or if they do, it is often limited to providing sufficient material in the cuff that the leg may be lengthened. This, however, requires bothersome time-consuming effort and some skill on the part of parents and, ideally, the use of equipment such as a sewing machine. Furthermore, even if the trouble is taken to resew the cuff, the alteration is often quite noticeable because the bottom of the pant leg becomes somewhat worn from being exposed to rubbing or brushing against the child's shoes or the floor. This area of wear leaves a noticeable line if the garment is then lengthened in the conventional way.

It is the purpose of this invention to provide a method for construction of children's garments, in particular, the cuff on the leg of pants or trousers, or the hem on skirts which will allow the garment to be lengthened, in an attractive way, when the child grows, without time-consuming efforts to reconstruct the bottom of the garment.

These and other advantages are provided in the present invention by a method of constructing the cuff of children's slacks or trousers, or the hem of a skirt which will allow the garment to be lengthened by easily removing a single line of stitching which will allow a predetermined width of the bottom of the garment to be turned down, thereby adding approximately one to two inches of length thereof.

This feature is achieved by constructing the cuff or hem of the garment using a method in which the cuff or hem is made by a series of steps in which the garment is first turned inside out and the bottom of the material is turned up approximately one cuff width and then turned up another cuff width, thereby establishing a three-layer cuff or hem at the bottom of the garment. A stitch is then permanently run around the bottom of the folds in this turned-up position. Next, a zig-zag stitch is run across the top of the turned-up portion stitching the turned-up portion tightly to the inside of the garment before the garment is turned right side out. By appropriate positioning of fasteners, this may also be used in the preparation of a garment for children still in diapers which has means for releasing or unfastening the inside seam as is common in overalls and slacks for younger children.

The nature and advantages of the present invention may be better understood by the following illustrated description of one embodiment thereof, employed on a pair of slacks, with reference to the drawings in which.

Figure 1:
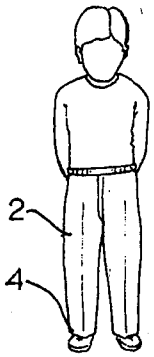
FIG. 1 illustrates a child wearing trousers made in accordance with the present invention.
Figure 2:
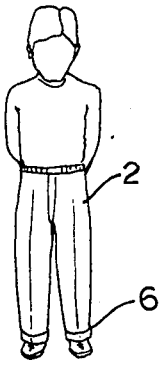
FIG. 2 illustrates the child in garment of FIG. 1 in which the legs of the trousers have been lengthened.

In FIG. 1 a child is illustrated wearing a pair of trousers 2, finished at the bottom at 4, in a manner which may be called straight leg or no cuff. In FIG. 2 the same child is illustrated wearing the same trousers in which the leg has been lengthened at the bottom, as shown at 6, to accommodate the child's growth. In accordance with the nature of this invention, the length and cuff appear in the form of a cuffed leg or a mock cuff, as will be discussed in greater detail hereafter.

The facility of the garment to be lengthened in this manner is a result of the manner in which the garment is made in accordance with this invention which will be described in the following details.

Figure 3:
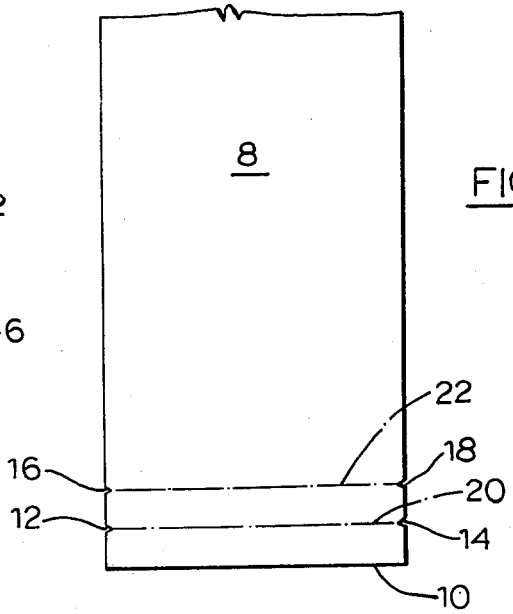
FIG. 3 illustrates a piece of cloth prepared for use in the manufacture of the leg and cuff of the garment such as shown in FIGS. 1 and 2.

FIG. 3 illustrates a portion of a piece of cloth 8, which portion is intended to comprise the pant leg of a garment such as 2 in FIG. 1. Near the lower end 10 of the piece of cloth (which, with modifications, will be approximately the bottom of the pant length of the garment), are a first pair of notches 12 and 14 respectively, made in the opposite sides of the material 8, and spaced upwards from the bottom 10 of the material a distance of approximately one and a half inches or equivalent to approximately the width of a normal pant leg cuff. A second pair of notches is made in the sides of the material at 16 and 18 respectively, spaced a further one and a half inches approximately up the garment, or a total of approximately three inches or two cuff widths from the bottom 10 of the material. These notches are useful in the manufacture of the garment, in that, they represent unmarked folding lines 20 and 22 respectively, which are illustrated as dotted lines in FIG. 3.

Figure 4:
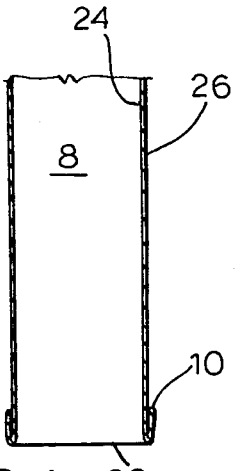
FIG. 4 is a vertical cross-section view of the leg of a trouser, inside out, and turned up one cuff width.

In FIG. 4, the material 8 is shown in cross-section after the sides have been sewn together in the seam to form a hollow tubular leg of a garment. It is important to note in FIG. 8 that the leg portion is turned inside out so that the right side of the material or the outside of the garment is in at 24 and the wrong side of the material of the inside of the garment is at this stage on the outside at 26. The bottom of the leg is turned up at the first fold line 20 opposite notches 12 and 14, that is turned up outwardly, as shown in FIG. 4, a distance approximately equal to one width of the cuff shown in FIG. 2.

The edge of the material 10 will then be approximately opposite the second fold line 22, not seen in FIG. 4.

Figure 5:
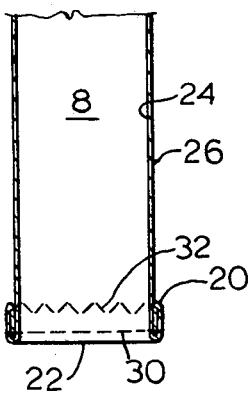
FIG. 5 illustrates the leg of FIG. 4 turned up a second cuff width.

In the next stage of the manufacture, the material 8 is shown in FIG. 5 turned up a second time so that the bottom of the leg of the garment is now at the fold line 22; fold line 20 is at the top of the folds and the bottom of the trouser leg is folded in three thicknesses. In this configuration, the garment is then stitched along a line running parallel and adjacent to the bottom of the leg 22, as illustrated at 30. Ideally, this is a permanent straight line stitch such as might be made on a sewing machine.

In the next step the top of the folds, as represented at 20, are stitched against the inside or wrong side of the material (although it is on the outside of the leg which is inside-out in FIG. 5) by means of a zig-zag stitch, illustrated at 32. Thus, the folds are secured along the top and bottom edges and it will be appreciated that when the garment is finished and the leg portion illustrated is turned right side out, the folds will be located up the inside of the bottom of the leg of the garment which will look as illustrated at 4 in FIG. 1.

Figure 6:
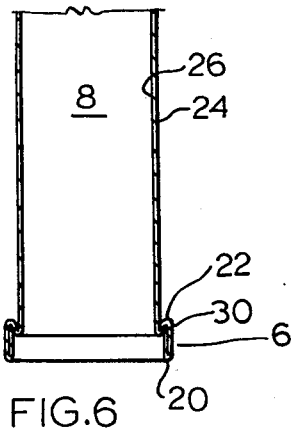
FIG. 6 illustrates the leg of FIG. 5, right side out, in which the leg has been lengthened.

As the child grows and it is necessary to lengthen the leg of the garment illustrated, this can be done easily by cutting the zig-zag stitching 32 holding the top of the double folded cuff of the garment, allowing the top edge of the fold 20 to drop down. This is illustrated in FIG. 6 in which it is important to remember that the leg of the garment is now right side out and therefore the reverse of the inside out arrangement is illustrated in FIGS. 4 and 5. With the zig-zag stitching 32 removed, the upper folded edge 20 is allowed to drop down and becomes the bottom of the garment approximately one cuff length longer or lower than in the configuration of FIGS. 2 and 5. The permanent stitching 30 remains and the fold line 22 which was previously at the bottom of the leg of the garment is now the top of the cuff (or what is more precisely referred to as a mock cuff) visible on the outside of the leg of the garment as at 6 in FIGS. 2 and 6. Although some pressing may be required, no difficult fitting or sewing is involved, and the relatively simple operation of severing the stitching 32 will make the desired modification in the garment.

Furthermore, although the bottom fold 22 of the material may be somewhat worn by brushing or rubbing against the child's shoes, this spot remains on the crease of a fold at 22 in FIG. 6 where it would be much less conspicuous than it would be if the entire bottom of the led was resewn and the worn lines showed on a flat portion of the material.

The arrangement of this method of construction is additionally advantageous, in that, neither the original configuration of FIG. 5 nor the final configuration of FIG. 6 provides a deep cuff which would fill with sand or dirt in which children often play.

Figure 7:
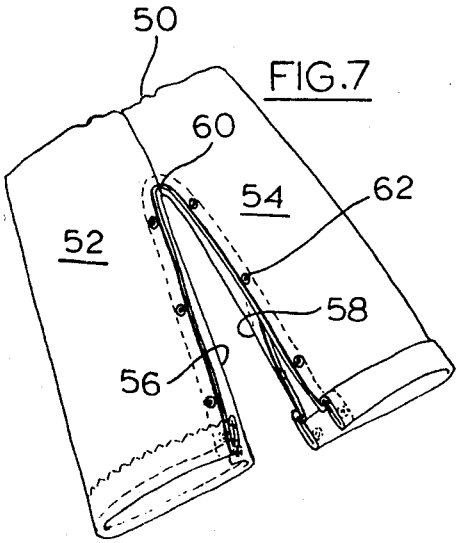
FIG. 7 illustrates the garment made in accordance with this invention in which the inner seam is releasably fastened by fasteners.

FIG. 7 illustrates a type of children's garment which is often used for young children in diapers. The garment 50 has legs 52 and 54 in which the in-seams 56 and 58 and the crotch 60 are not permanently stitched closed, but are fastened by releasable fasteners such as 62, which allow the garment to be opened along the in-seam to allow the child's diapers to be changed.

Figure 9:
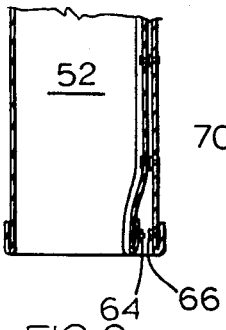
FIG. 9 illustrates a further stage in the manufacture of the garment in FIG. 7.

In the manufacture of this type of garment, it is necessary to provide for the fasteners. In FIG. 9 the first fold stage is illustrated with the material in the inside out position. One-half of a snap fastener 64 is outwardly facing on the up-turned portion of the leg and the other half 66 of the snap fastener is inwardly facing at the same level on the on-turned portion of the leg.

Figure 10:
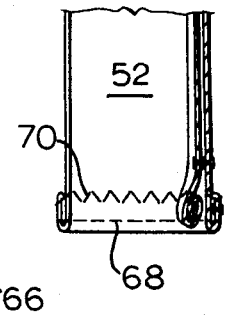
FIG. 10 illustrates the final manufactured configuration of a portion of the garment in FIG. 7.

In FIG. 10 the same leg is illustrated in the completed manufactured stage having permanent stitching 68 and zig-zag stitching 70 in which one-half of the dome fastener 64 is folded internally while the other half of the fastener 66 is exposed but to the inside of the garment in its final right side out arrangement.

Figure 11:
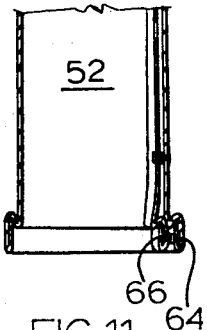
FIG. 11 illustrates the garment in FIG. 7 having been turned down or lengthened.

By this arrangement it can be seen in FIG. 11 that when the garment is lengthened by severing the zig-zag stitching 70, the two halves of the snap fastenerrs 64 and 66 will be facing opposite each other to allow the bottom of the leg of the garment to be fastened.

The other fasteners on the rest of the in-seam of the garment are, of course, unaffected by the construction or arrangement of the present invention.

Figure 8:
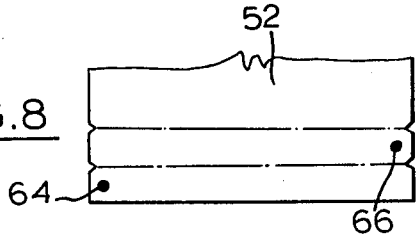
FIG. 8 illustrates a portion of the garment of FIG. 7 at an early stage of construction.

In FIG. 8 the location of the two halves of the fasteners 64 and 66 on the unstitched unfolded material of the leg 52 are illustrated.

Although the illustrated use of the present invention relates to the cuff or the bottom of the legs of trousers, this invention might be used with or without modification and variants in other ways and other garments which require alteration. For instance, a similar construction technique might be employed to construct the hem of a girl's skirt, and although the length or height of a hem line on a skirt is not quite as critical as the bottom of trousers, the skirt could be lengthened a predetermined amount in a simliar way to the illustrated embodiment when the skirt becomes noticeably too short. The invention could also be used for other similar parts of children's garments such as the cuff at the end of the sleeve of jackets.

Furthermore, a cuff or hem which is constructed in accordance with this invention may not only be lengthened, but if desired, could be shortened again merely by turning the mock cuff back up and replacing the zig-zag stitching.

It will, of course, be appreciated that although the illustrated techniques are considered typical of the preferred embodiment of the invention, other modifications, variants and equivalents might be employed in the use of this invention without departing from the inventive concept herein.

What I claim as new and desire to protect by Letters Patent of the United States is as follows:

1. A method of constructing children's garment to allow them to be lengthened comprising the steps of:

cutting and sewing the garment with sufficient excess material to allow the bottoms to be turned up twice a predetermined width, said garment having a first lower edge, an inner wrong side, and an outer right side;

turning said first lower edge a first predetermined width towards the wrong side of the material to form a second lower edge;

turning up said newly formed second lower edge a second predetermined width towards the wrong side of the material to form a third lower edge;

sewing a permanent stitch through all the layers of said material along a line parallel to and adjacent to the third lower edge of said turned-up material;

stitching the top of said turned-up material to the unturned portion of the remainder of said material with an easily removable zig-zag stitch.

2. The method as claimed in claim 1 in a garment having an openable in-seam, including the steps of fixing one-half of a dome fastener on the first turned-up portion adjacent one side of the in-seam of said garment and fixing the other half of said fastener on the second turned-up portion adjacent the other side of the said in-seam of said garment, both of said fastener halves facing from the right side of said material.

* * * * *